United States Patent [19]

Woodings

[11] 4,129,679

[45] Dec. 12, 1978

[54] MULTI-LIMBED REGENERATED CELLULOSE FILAMENTS

[75] Inventor: Calvin R. Woodings, Nuneaton, England

[73] Assignee: Courtaulds Limited, London, England

[21] Appl. No.: 511,434

[22] Filed: Oct. 2, 1974

Related U.S. Application Data

[63] Continuation of Ser. No. 280,113, Aug. 14, 1972, abandoned, which is a continuation-in-part of Ser. No. 92,799, Nov. 25, 1970, abandoned.

[30] Foreign Application Priority Data

Nov. 27, 1969 [GB] United Kingdom ..... 58002/69

[51] Int. Cl.[2] ..... D02G 3/00

[52] U.S. Cl. ..... 428/398; 264/188; 264/209; 264/210 F; 428/397

[58] Field of Search ..... 161/177, 178; 264/188, 264/209, 210 F, 168, 198; 428/397, 398, 364

[56] References Cited

U.S. PATENT DOCUMENTS

| | | | |
|---|---|---|---|
| 2,492,425 | 12/1949 | Hall et al. | 161/178 X |
| 2,835,551 | 5/1958 | Kosuge | 264/188 X |
| 3,156,605 | 11/1964 | Anderer et al. | 161/178 X |
| 3,626,045 | 12/1971 | Woodings | 264/188 X |
| 3,670,069 | 7/1972 | Mitchell et al. | 161/177 X |

FOREIGN PATENT DOCUMENTS 945306 12/1963 United Kingdom.

*Primary Examiner*—Lorraine T. Kendell
*Attorney, Agent, or Firm*—Davis, Hoxie, Faithfull & Hapgood

[57] ABSTRACT

Highly absorbent regenerated cellulose filaments have a collapsed hollow structure, a multi-limbed cross-section and a water imbibition of 170 to 345 per cent. They are made by a viscose process using sodium carbonate as an inflating agent.

2 Claims, 1 Drawing Figure

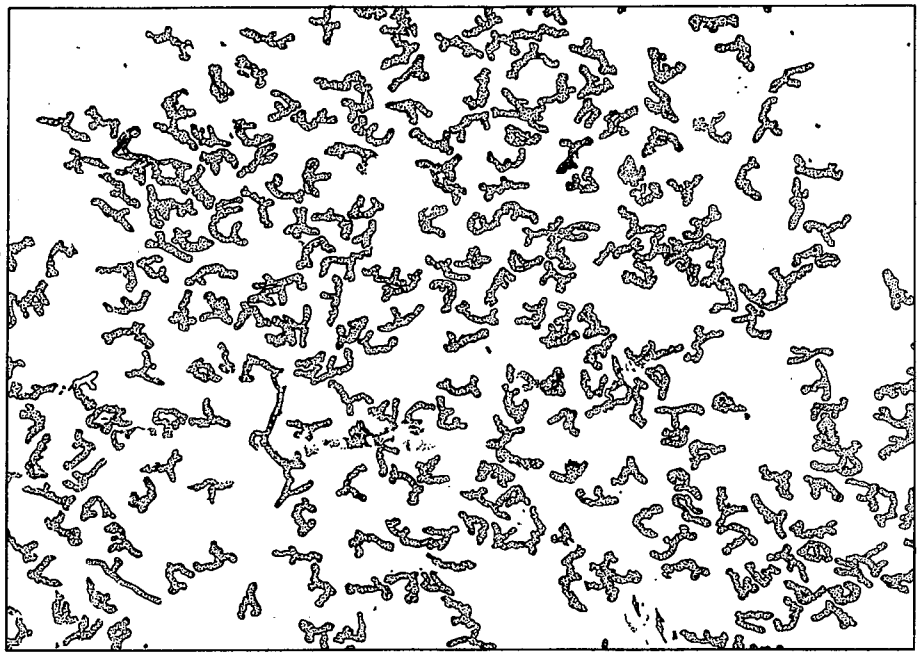

MULTI-LIMBED REGENERATED CELLULOSE FILAMENTS

This application is a continuation of my prior application Ser. No. 280,113 filed Aug. 14, 1972, and now abandoned which itself is a continuation-in-part of my prior application Ser. No. 92,799 filed Nov. 25, 1970 and now abandoned.

This invention relates to multi-limbed filaments of regenerated cellulose, and to a process for making them from viscose.

In the viscose art, there have been various proposals for making hollow regenerated cellulose filaments by inflating the filaments during regeneration using a material dispersed in the viscose which is either a gas, or a solid which releases a gas on contact with the spin bath. Alkali carbonates, particularly sodium carbonate, are the most commonly used inflation materials. The type of hollow structure aimed at has varied and early efforts were directed at making tubular or cellular structures in which the filament stayed inflated to provide a bulky, low density yarn giving good cover in fabrics made from it. Filaments of this type are described in U.S. Pat. Nos. 2,476,293 and 2,835,551 (cellular) and Japanese Pat. No. 40-9064 (tubular).

More recently, there has been interest in making inflated filaments which collapse upon themselves to form flat filaments which, because of this flat shape, bond to each other strongly by hydrogen bonding; this characteristic makes them very suitable as paper-making fibres. Filaments of this type are described in British Pat. No. 945,306 and U.S. Pat. Nos. 3,156,605 and 3,318,990. Another interesting characteristic of these filaments is their high water absorbency, which surprisingly, is higher than that of inflated tubular filaments. For example, the flat filaments (British Pat. No. 945,306) and the hollow filaments (U.S. Pat. No. 3,626,045) made by Courtaulds Limited have water imbibitions which average about 140 percent and 125 percent respectively. Unfortunately, the self-bonding property which makes the flat filaments so useful in paper-making, is detrimental to their use in absorbent textile products because it makes them virtually unprocessable; thus, they bond to each other on being dried after wet processing and prevent, say, satisfactory carding.

It is an object of this invention to provide regenerated cellulose filaments which have an even higher water absorbency, and which can be processed satisfactorily, by a modified viscose process.

This invention resides in a bundle (by which is meant a tow comprising at least 10,000 filaments or a collection of at least the same number of staple fibres cut from such a tow) of highly absorbent, regenerated cellulose filaments, substantially all of the filaments of said bundle having a collapsed hollow structure, and at least 60 percent of said filaments comprising in cross-section at least three elongated limbs extending from a common origin, the water imbibition of said bundle being from 170 to 345 percent. The collapsed hollow structure confers high absorbency on the filaments, which swell as they absorb water, revealing their hollow structure when examined in cross-section. The multi-limbed cross-section, which is retained even after swelling, allows the filaments to be processed by the usual fibre and textile processing methods, and in addition confers an even greater absorbency on products made from the filaments by virtue of the capacity of the filament bundle to hold large quantities of interstitial water between adjacent limbs of the filaments. The filaments have a high bulk and a cotton-like handle, and they have a dull matt appearance even without pigmentation because the multi-limbed cross-section causes scattering of reflected light. In the bundle of filaments, various cross-sections will be obtained including roughly Y-, X- and H- shapes and more complicated shapes.

The FIGURE is a reproduction of a photograph of a cross-section of a tow of filaments according to the invention as produced by the process specifically described in Example 2 below.

The bundle of filaments of the invention may be made by a viscose process using sodium carbonate as the inflating agent. The process conditions are selected so that the inflation process and the regeneration process are balanced to produce the desired structure. Thus, sufficient inflation is permitted so that the filament can subsequently collapse, but this is balanced by having a sufficiently strong regeneration reaction to form a skin on the inflating filaments which is thick enough to prevent too much inflation with subsequent collapse to a flat structure.

Virtually any commercial viscose may be used, and the majority have a cellulose content of 6.5 to 12 percent by weight and a caustic soda content of 4 to 10 percent. It is important, however, that the spinning viscose should have a low salt figure in the range 3.5 to 5.1. At higher salt figures, a spun tow would have an increasing percentage of flat filaments as the salt figure was raised above 5.1 until at a salt figure of about 7 the tow would be virtually all flat filaments. The ball fall viscosity of the viscose is usually in the range 30 to 180 seconds at 18° C. The amount of sodium carbonate in the viscose should be in the range 2 to 5 percent by weight. Insufficient inflation would be achieved with less, in view of the comparatively thick skin formed during regeneration.

The spin bath may be a conventional bath having a low zinc sulphate content or even no zinc sulphate; a range of 0 to 3 percent by weight is suitable. The sulphuric acid concentration may be within wide limits, 9 to 20 percent by weight but is preferably nearer the lower end of the range. 20 to 26 percent by weight of sodium sulphate is a suitable range.

The temperature of the spin bath is unusually high for making inflated filaments, 60° C. to 85° C., and is designed to produce the desired skin thickness during regeneration so as to avoid too great an inflation. As the temperature is lowered below 60° C., an increasing amount of flat fibre is produced.

The spun filaments may be subjected to the usual washing and stretching operations, preferably being stretched at least 10 percent in a hot, dilute aqueous sulphuric acid bath, for example 2 percent by weight at a temperature of 95° C. For most end-uses, stretching up to about 70 percent is sufficient to give adequate filament strength. The process is most efficient when producing filaments of count 0.5 to 10 dTex.

Within the ranges specified above, in general the conditions for producing the bundle of multi-limbed filaments of the invention, move away from the optimum as the salt figure of the viscose is raised, as the zinc sulphate concentration of the spin bath is increased, and as the temperature of the spin bath is lowered. These shifts in conditions can be compensated for by lowering the concentration of the sodium carbonate in the viscose or by lowering the sulphuric acid concentration in the spin bath. Also, an increased salt figure can be compensated for by raising the spin bath temperature. The sodium carbonate and sulphuric acid concentrations are interdependent because at lower acid concentrations, more sodium carbonate is lost in the spin bath so that a greater initial concentration is required for comparable inflation with that at higher acid concentrations. Economic factors affect the chosen conditions, with lower acid and sodium carbonate concentrations being preferred for this reason. Similarly, it is preferred not to operate at the higher end of the spin bath temperature range, and about 70° C. is the preferred norm.

The bundle of multi-limbed filaments of the invention is capable of a wide application of use, both in staple fibre and continuous filament form, and particularly in end-uses which take advantage of its high water imbibition. These include woven fabrics like towelling and non-woven fabrics and waddings such as diapers, sanitary napkins, tampons and swabs. Conventional textile end-uses may benefit from the good cover and high bulk provided by the filaments at low basis weight. In staple fibre form, the filaments may be made into soft, bulky paper which is highly absorbent by mixing them with the flat, regenerated cellulose fibres referred to in British Pat. No. 945,306 or with conventional wood-pulp paper-making fibres.

The invention is illustrated by the following Examples in which percentages are by weight except for stretches.

EXAMPLE 1

A viscose comprising 7.85 percent cellulose, 5.23 percent caustic soda and 2.55 percent sodium carbonate, and with a salt figure of 3.8 and a ball fall viscosity of 35 seconds at 18° C., was extruded into an aqueous spin bath comprising 13.5 percent sulphuric acid, 0.8 percent zinc sulphate, 24.0 percent sodium sulphate and 61.7 percent water to form a tow of filaments having an average count of 1.7 d.Tex.

The temperature of the spin bath was 70° C. and the immersion path length was 24 inches. The spinning speed was 30 meters per minute. The spun tow of filaments was stretched by 30 percent in a 2 percent aqueous sulphuric acid stretch bath at a temperature of 95° C. and then the filaments were washed.

The filaments of the tow were predominantly of multi-limbed cross-section specified with a small proportion of filaments having the round cross-section of conventional regenerated cellulose filaments.

The filaments had an average water imbibition of 170 percent. The water imbibition was measured by taking a 1 gm. sample of the fibre, soaking it in water at a temperature of 20° C. for 15 minutes, centrifuging it at a force of 1000 g for 5 minutes, weighing it, drying it at a temperature of 110° C. for 2.5 hours, and finally reweighing it. The percentage water imbibition is then equal to:

$$\frac{\text{weight of wet fibre} - \text{weight of dry fibre}}{\text{weight of dry fibre}} \times 100$$

EXAMPLE 2

A viscose comprising 8.05 percent cellulose, 5.28 percent caustic soda and 2.54 percent sodium carbonate, and with a salt figure of 5.1 and a ball fall viscosity of 30 seconds at 18° C., was extruded into an aqueous spin bath comprising 13.55 percent sulphuric acid, 0.7 percent zinc sulphate and 23.0 percent sodium sulphate to form a tow of filaments having an average count of 2.65 d.Tex.

The temperature of the spin bath was 66° C. and the immersion path length was 24 inches. The spinning speed was 30 meters per minute. The spun tow of filaments was stretched by 25 percent and washed.

The filaments of the tow were of the specified multi-limbed cross-section and had the specific appearance shown in the drawing. They had an average water imbibition of 220 percent.

EXAMPLE 3

A viscose comprising 7.45 percent cellulose, 5.08 percent caustic soda and 2.4 percent sodium carbonate, and with a salt figure of 4.1 and a ball fall viscosity of 31 seconds at 18° C., was extruded into an aqueous spin bath comprising 13.5 percent sulphuric acid, 0.8 percent zinc sulphate, 23.5 percent sodium sulphate to form a tow of filaments having an average count of 2.5 d.Tex.

The temperature of the spin bath was 70° C. and the immersion path length was 24 inches. The spinning speed was 30 meters per minute. The spun tow of filaments was stretched by 25 percent and washed.

The filaments of the tow were of the specified multi-limbed cross-section and had an average water imbibition of 280 percent.

EXAMPLE 4

A viscose comprising 7.86 percent cellulose, 5.08 percent caustic soda and 3.4 percent sodium carbonate, and with a salt figure of 5.0 and a ball fall viscosity of 28 seconds at 18° C., was extruded into an aqueous spin bath comprising 10.5 percent sulphuric acid, 0.8 percent zinc sulphate and 24.0 percent sodium sulphate to form a tow of filaments having an average count of 2.75 d.Tex.

The temperature of the spin bath was 72° C. and the immersion path length was 24 inches. The spinning speed was 30 meters per minute. The spun tow of filaments was stretched by 25 percent and washed.

The filaments of the tow were of the specified multi-limbed cross-section and had an average water imbibition of 310 percent.

EXAMPLE 5

A viscose comprising 7.2 percent cellulose, 4.9 percent caustic soda and 3.0 percent sodium carbonate, and with a salt figure of 4.1 and a ball fall viscosity of 28 seconds at 18° C., was extruded into an aqueous spin bath comprising 13.5 percent sulphuric acid, 0.8 percent zinc sulphate and 24.0 percent sodium sulphate to form a tow of filaments having an average count of 2.5 d.Tex.

The temperature of the spin bath was 70° C. and the immersion path length was 24 inches. The spinning speed was 30 meters per minute. The spun tow of filaments was stretched by 25 percent and washed.

The filaments of the tow were of the specified multi-limbed cross-section and had an average water imbibition of 345 percent.

What is claimed is:

1. A bundle of highly absorbent, regenerated cellulose filaments, substantially all of the filaments of said bundle having a collapsed hollow structure, and at least 60 percent of said filaments comprising in cross-section at least three elongated limbs extending from a common origin, the water imbibition of said bundle being from 170 to 345 percent.

2. A bundle of regenerated cellulose filaments as claimed in claim 1 in which the filaments have a count in the range 0.5 to 10 d.Tex.

* * * * *